United States Patent [19]

Leib

[11] 3,938,357

[45] Feb. 17, 1976

[54] CLEANING MACHINE UTILIZING NON-LIQUID CLEANING AGENTS

[76] Inventor: Joseph Leib, 4835 W. Jefferson Blvd., Los Angeles, Calif. 90016

[22] Filed: July 1, 1974

[21] Appl. No.: 484,816

[52] U.S. Cl. ..... 69/23; 34/133; 68/20

[51] Int. Cl.[2] ..... C14B 15/00

[58] Field of Search ..... 69/23, 28; 34/133, 139; 68/18 R, 20, 142, 131; 8/142

[56] References Cited

UNITED STATES PATENTS

| | | | |
|---|---|---|---|
| 1,377,247 | 5/1921 | Heineke | 69/23 |
| 3,381,507 | 5/1968 | Burgo et al. | 69/23 |
| 3,504,510 | 4/1970 | Freeze et al. | 69/23 X |
| 3,512,268 | 5/1970 | Miller et al. | 34/133 X |

*Primary Examiner*—Richard E. Aegerter
*Assistant Examiner*—Michael H. Thaler
*Attorney, Agent, or Firm*—Flam & Flam

[57] ABSTRACT

Cleaning drapes, furs or other objects by the aid of powdered and/or granular cleaning agents involves a two part operation. During the first part of the cycle, the material to be cleaned and the cleaning agent are tumbled together in an oscillating drum. During the second part of the cycle, the cleaning agent is drawn off by vacuum. Tumble vanes in the drum are apertured whereby the vanes themselves serve as effluent conduits. Interior baffles in the tumble vanes keep the powdered and/or granular cleaning agent in the drum while the effluent conduits remain open. An efficient removal of the used cleaning agent is accomplished since the material cleaned cannot block all the effluent conduits.

5 Claims, 5 Drawing Figures

CLEANING MACHINE UTILIZING NON-LIQUID CLEANING AGENTS

FIELD OF INVENTION

This invention relates to machines for cleaning draperies, furs and other objects with the use of powdered and/or granular cleaning agents. Cleaning with non-liquid agents of this character requires, first, a tumble operation in which the cleaning agent is exposed to the work and, second, an exhaust operation in which the cleaning agent is withdrawn while the work continues to tumble to separate the particulate matter.

Two separate machines can be for the two operations; however, this requires an undesirable handling operation. Desirably, removal of the used particulate matter takes place in the same drum used for cleaning.

BACKGROUND OF INVENTION

U.S. Pat. No. 3,504,510, issued Apr. 7, 1970 to Daniel Freze, et al. discloses a drum having an effluent duct at the rear and opposite the loading door. A baffle plate hopefully keeps the work away so that the effluent duct remains open during the exhaust cycle. In practice, an operator must continually inspect the drum to stop the drum and pull the work away. U.S. Pat. No. 3,381,507 issued May 7, 1968 to Harold C. Burgo et al. discloses a drum provided with peripheral openings. With the work always falling to the bottom, the openings on top cannot be clogged. Hence a good uninterrupted flow of air is ensured. However, Burgo's machine requires an axially movable wall to expose the apertured drum part at one end to the unapertured drum part at the other only during the purging part of the operation so that the cleaning agent isn't lost during the cleaning part of the cycle. The Freze machine has the advantage that the drum is unchanged during both parts of the cycle and consequently requires no mechanisms that must be serviced. The Burgo machine makes possible a very certain and effective purging of used cleaning agent.

The primary object of this invention is to provide an improvided cleaning machine of this character that utilizes peripheral effluent openings without requiring any moving mechanisms to retain the cleaning agent in the drum during the cleaning part of the cycle. Accordingly high volume purging air flow is achieved without any possibility of the work clogging the effluent openings.

SUMMARY OF THE INVENTION

The foregoing object is made possible by the use of tumble vanes in the drum that have ports along one side and that have bases opening peripherally of the drum. Thus air for removing the used cleaning agent flows through large peripheral openings. Inside each tumble vane is a baffle plate that in the absence of forced air flow returns any entering cleaning agent to the drum. The baffle plate allows cleaning agent to be pushed up for removal from the drum and via the tumble vanes when air is forced through the drum.

BRIEF DESCRIPTION OF THE DRAWINGS

A detailed description of the invention will be made with reference to the accompanying drawings wherein like numerals designate corresponding parts in the several figures.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Figure 2:
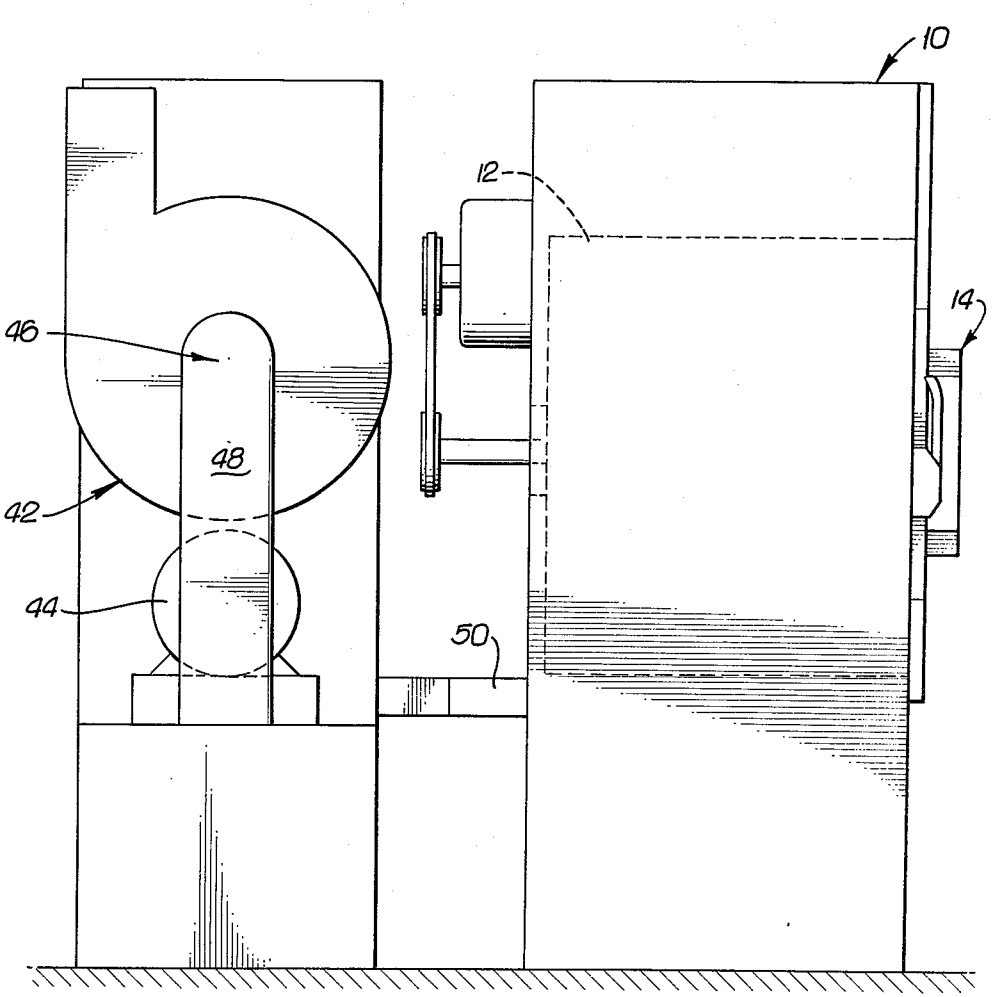
FIG. 2 is a side elevational view thereof, and showing the blower component as well as the drum component of the machine.
Figure 1:
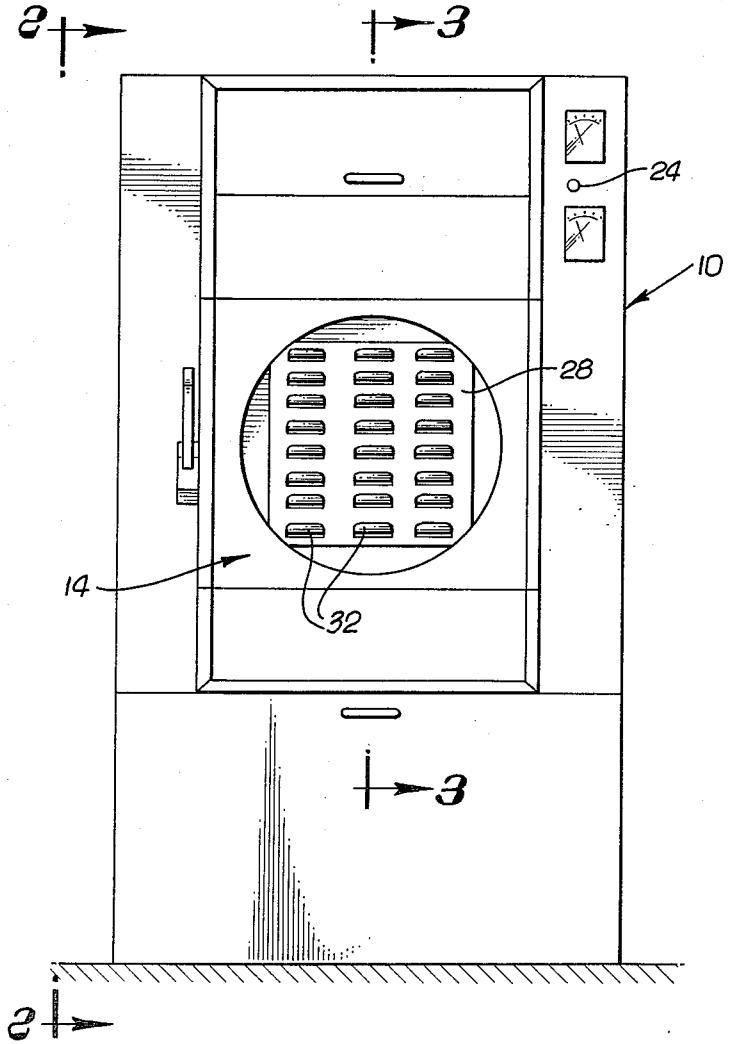
FIG. 1 is a front elevational view of a cleaning machine incorporating the present invention, and showing the loading door.
Figure 3:
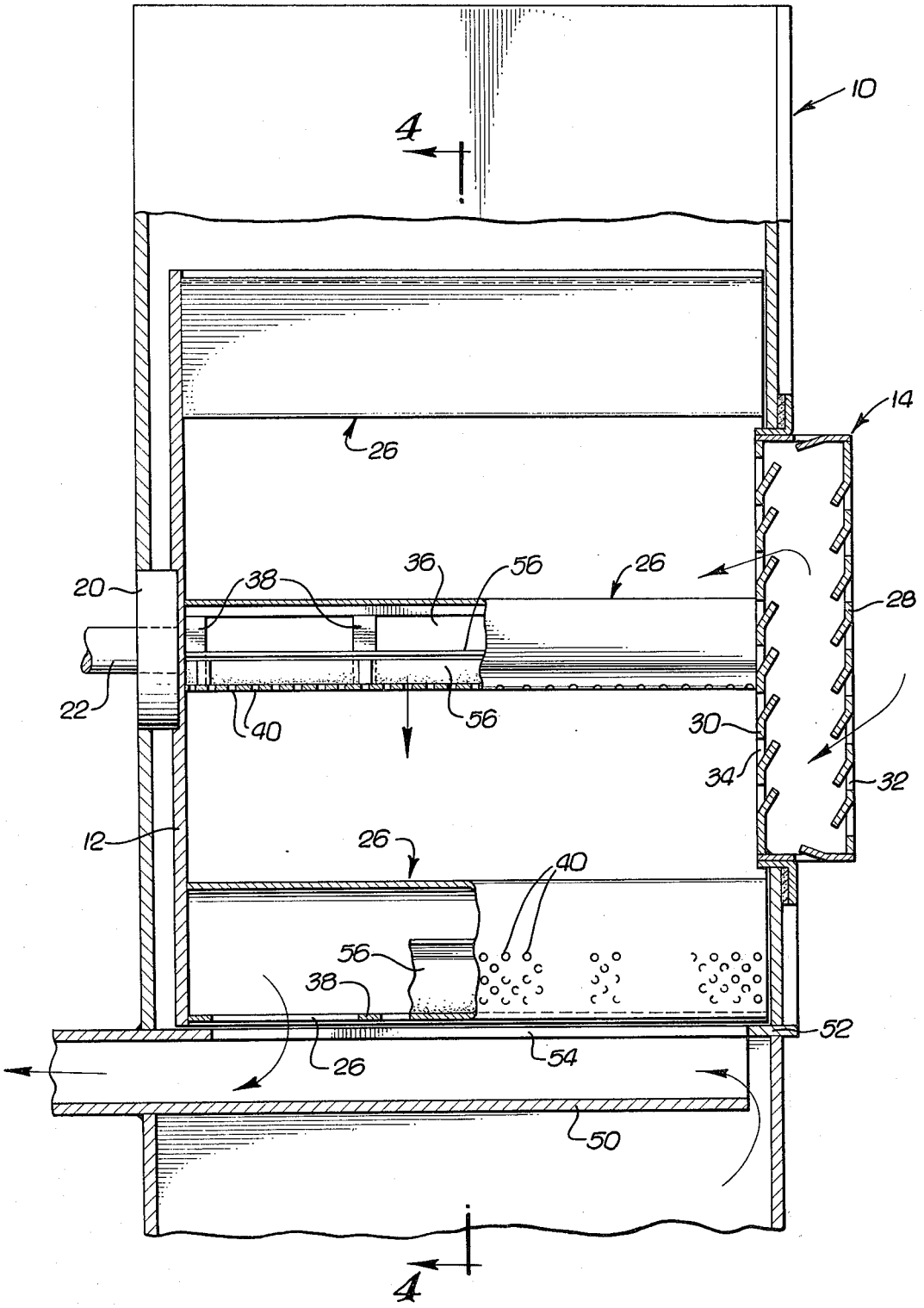
FIG. 3 is a vertical sectional view of the machine with the section plane passing through the horizontal axis of the drum, and as indicated by line 3—3 of FIG. 1.

In FIGS. 1 and 2 there is illustrated a cabinet 10 in which a cleaning drum 12 (FIGS. 3 and 4) is mounted. The drum is supported for rotation about a horizontal axis for front loading through a door 14 (FIGS. 1 and 3). The drum is supported in the cabinet 10 at its front end by two roller bearings 16 and 18 (FIG. 4) that engage the outside bottom of the drum. The drum is supported at its inner end by a bearing 20 through which a drive shaft 22 extends.

During the cleaning mode, the drum 12 is loaded with furs, drapes or other work together with suitble amount of cleaning agents. The door is closed and a start switch 24 on the front of the cabinet (FIG. 1) is operated. Automatic controls cause the drum to rotate in alternate directions for a preset period of time. Tumble vanes 26 of generally triangular cross-sectional configuration project inwardly of the drum to assist in the movement of the work whereby suitable contact between the cleaning agent and the work is ensured. In the present instance, four tumble vanes are provided, prefereably equiangularly located.

The drum 12 has an air influent opening and an air effluent whereby a forced air flow removes the used cleaning agent upon the completion of the cleaning mode. During the cleaning cycle, there is no forced air flow, and the cleaning agent is confined to the drum. During the forced air flow or purging mode, the drum continues to rotate in alternate directions.

The influent opening to the drum is forced through the door 14. The door 14 has an outer and an inner perforated plate 28 and 30 both vertically oriented and spaced from each other. The outer plate has its perforations formed by horizontal lances 32 (FIG. 1) with portions of the plate upwardly adjoining the lances bent inwardly FIG. 3). The inner plate 30 has its perforations formed by horizontal lances 34 but with the portions downwardly adjoining the lances bent outwardly to avoid snagging the material in the drum. Thus the powdered or granular cleaning agent in the drum that may be thrown against the inner plate of the door 14 cannot easily exit through the door. In order to do so, the cleaning agent must actually rise vertically through the openings. Any material that happens to pass through the inner plate is caught between the plates by virtue of the downward slant of the inwardly formed portions of the outer plate 28. The plates are spaced from each other in an amount sufficient to prevent undue throttling of influent air.

Figure 4:
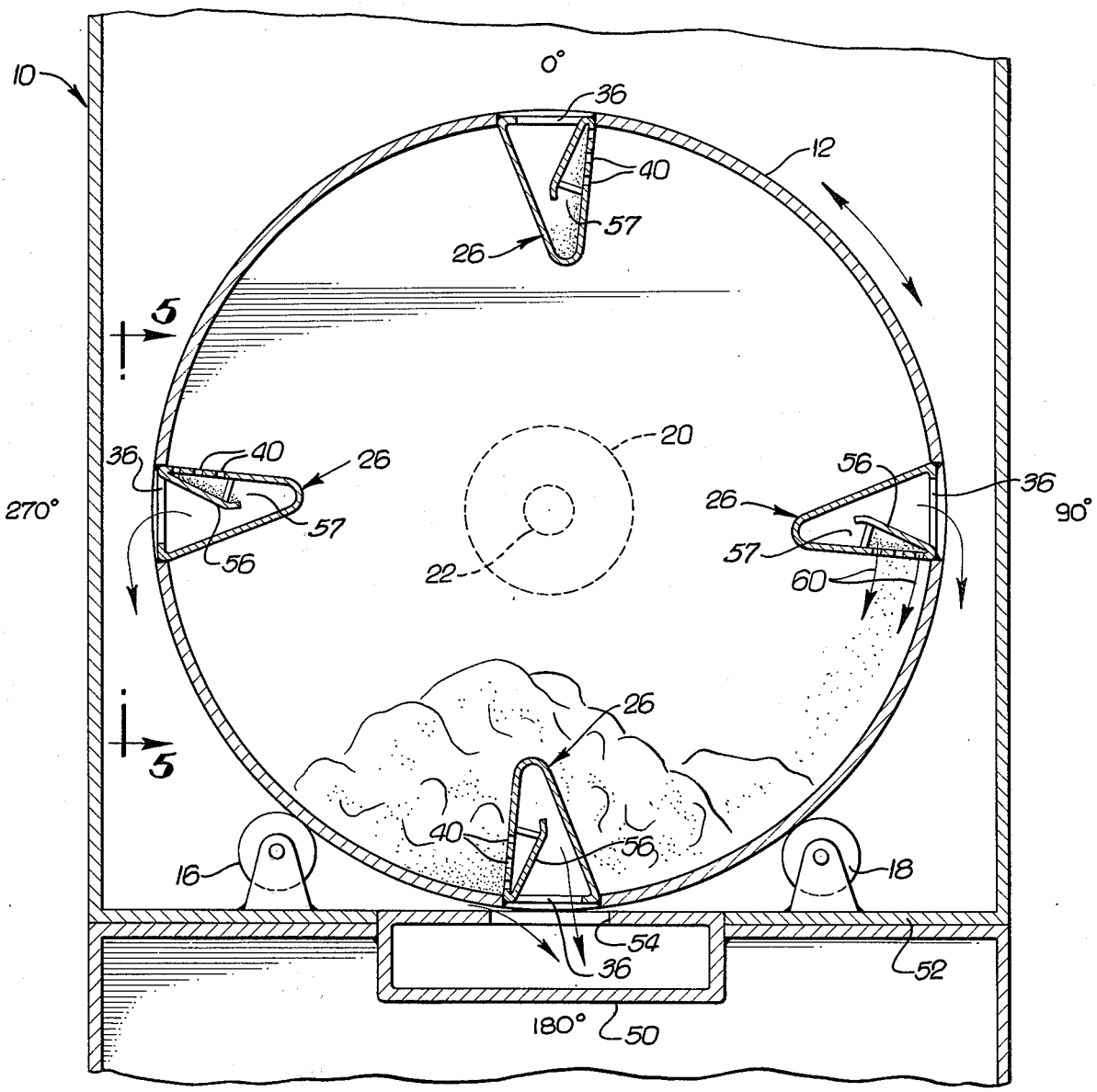
FIG. 4 is a transverse sectional view of the drum, and along a plane indicated by line 4—4 of FIG. 3.
Figure 5:
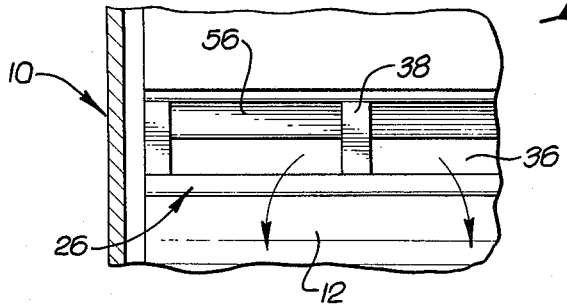
FIG. 5 is a fragmentary detailed elevational view of the bottom of one of the tumble vanes, and from the outside of the drum as indicated by line 5—5 of FIG. 4.

The effluent opening from the drum is formed by large peripheral openings 36 (See FIGS. 4 and 5). The openings 36 register with the bases of the tumble vanes 26. There are four sets of openings corresponding to the number of tumble vanes. Each set of openings comprises a series that extends along the entire length of the drum, there being webs or straps 38 (FIG. 5) that join the drum portions segmented by the openings 36. One side of each of the tumble vanes (See also FIG. 3) has perforations 40 extending along the entire length of the vane and from the base portion thereof to approximately half the vane height. The combined area of all of the perforations of all of the vanes is quite large in order to ensure a rather substantial air flow through the drum. Flow through the drum is ensured by positioning the distal edges of the drum very close to the inner wall of the cabinet, and as shown in FIG. 3.

In order to induce flow through the door 14 and the peripheral drum openings 36, a centrifugal blower 42 (FIG. 2) is provided at the rear of the cabinet 10. The blower is driven by a motor 44. The inlet 46 to the blower is connected to the cabinet part that surrounds the cleaning drum, this cabinet part being otherwise substantially sealed. For this purpose, vertical and horizontal duct parts 48 and 50 are provided. The horizontal duct part projects rearwardly of the cabinet beneath an intermediate horizontal cabinet partition 52. The partition 52 in practice is formed by juxtaposed bottom and top walls respectively of a top cabinet part and a bottom cabinet part each formed as box-like elements. The duct 50 as shown in FIGS. 3 and 4 opens into the upper cabinet part via an elongate opening 54.

During the purging cycle, the work may overlie tumble vanes at or near the bottom of the drum. But other tumble vanes at or near the top are clear for free passage of air through the drum. Thus while passages in one or some of the tumble vanes may be occluded, passages in the others must be open. There is virtually no danger of all of the effluent openings being simultaneously blocked by the work. Consequently gravity compels the work to drop to the bottom of the drum, thereby ensuring air flow.

During the cleaning part of the cycle, the cleaning agent must be confined to the drum. For this purpose, each vane has a baffle plate 56. The baffle plate 56 forms a trough-like trap inside the vane, the trap or trough having an opening 57 facing radially inwardly of the drum and having a radial dimension greater than the width of the band of perforations. By virtue of this configuration, the cleaning agent stays in the drum absent an induced flow of air. The baffle plates are formed integrally with the tumble vanes, as by a bending operation.

The drum rotates in both directions to prevent tangling of the work. If the direction of rotation is such that the perforations are on the trailing face of the tumble vane, corresponding to counterclockwise rotation as viewed in FIG. 4, then the used cleaning agent generally falls downwardly and away from the perforations 40 as the tumble vane moves from the 180° position to the 90° position. Any material in the trough or trap will fall back through the perforations 40 before the tumble vane reaches the top or 0° position. No significant amount of cleaning agent falls on the perforated face of the 270° position. Therefore, rotation with the perforated face trailing ordinarily does not cause cleaning agent to move outwardly of the drum.

If the direction of the rotation is such that the perforations are on the leading face of the tumble vane, corresponding to clockwise rotation as viewed in FIG. 4, cleaning material is scooped up at the 180° position and into the trap formed by the baffle 56. The material stays in the trap until the 270° position is reached at which point the material falls into the tumble vane. However, at this point, the tumble vane is inverted or is beginning to be inverted. Hence the cleaning agent is held inside the apex of the tumble vane. Upon rotation beyond the 90° position, the cleaning agent in the tumble vane slides downwardly into the trap at the perforated part of the tumble vane. The cleaning material falls back into the drum and as indicated by arrows 60.

In order to ensure containment of the cleaning agent during the cleaning cycle, there should be a near or actual overlapping or angularly offset relationship between the edge of the drum opening. In practice an actual offset or overlap is not required since friction and inertia prevent outward movement of the cleaning agent.

Notwithstanding the fact that there are no moving parts for opening and closing effluent openings, cleaning agent stays in the drum until the purging or forced air part of the cycle begins. Since the effluent openings for the drum are located on the cylindrical periphery, high volume air flow purges the used cleaning agent without danger of blocking the air flow path.

ALTERNATIVE EMBODIMENTS

While the drawings disclosed tumble vanes with the perforated faces on corresponding sides, obviously the perforated faces could be on either or both sides.

Intending to claim all novel, useful and unobvious features shown or described, I make the following claims:

1. In a cleaning machine for use with powdered and/or granular cleaning agents:

a. a cleaning drum having a front air influent opening;

b. means supporting the cleaning drum for angular movement about a substantially horizontal axis;

c. means forming an enclosure for the drum, including an access door registering with said drum front opening;

d. said door having openings for admission of air to the drum;

e. means operable to exhaust air from said enclosure;

f. a plurality of hollow tumble vanes in the drum and extending inwardly from the periphery of the drum; said tumble vanes having a series of openings for flow of air and entrained cleaning agents from the drum to the interior of the tumble vanes;

g. means forming effluent openings at the region of the bases of the tumble vanes and providing communication between the interior of the tumble vanes and said enclosure at the periphery of said drum; and h. baffle plates in said tumble vanes for gravity return of cleaning agent to the interior of said drum in the absence of a current of air induced by said air exhausting means.

2. The cleaning machine as set forth in claim 1 in which said tumble vanes have surfaces on opposite sides, at least one of which is provided with said openings in an array extending only partially from the base of said one surface toward the distal end of the tumble vane; the said baffle plates extending in spaced relationship behind said array of holes to form a trap for entering cleaning agent, the trap opening beyond the array of holes.

3. The cleaning machine as set forth in claim 1 in which said door comprises a pair of spaced plates with louver-like openings formed by stamped regions adjoining lances in the plates, the inner plate having stamped regions projecting inwardly to shield the edges of the lances from the material in the drum; the louver-like openings in the respective plates being oriented so that cleaning agent impinging on the inner plate is directed to return to the drum and so that the material impinging upon the outer plate is directed to return to the space between the plates.

4. The cleaning machine as set forth in claim 1 in which each of said baffle plates extend behind one side of the corresponding tumble vane with a proximal edge on the same side of the corresponding effluent opening as said one tumble vane side and with a distal edge located radially inwardly and in spaced relationship to the baffle plate; said one tumble vane side having said openings in an array all of which openings lie opposite the baffle plate whereby cleaning agent entering the tumble vane via the openings is trapped by the baffle plate and returned to the drum via the openings upon continued angular movement of the drum.

5. In a cleaning machine for use with powdered and/or granular cleaning agents:

a. a cleaning drum having a circular edge forming front air influent opening;

b. means supporting the cleaning drum for angular movement about a substantially horizontal axis;

c. means forming an enclosure for the drum, and having a frontal opening registering with and surrounded by said drum opening, the said circular edge of said drum located in close proximity to said enclosure to form a substantially sealed relationship thereto;

d. an access door for said enclosure opening, and itself having air passages therethrough for entry of air into the drum;

e. an air pump operable to exhaust air from said enclosure following a cleaning cycle;

f. a plurality of tumble vanes in the drum of generally triangular cross-sectional configuration, each tumble vane having surfaces on opposite sides, one of which is provided with an array of openings for entry of air into the tumble vane;

g. said drum having effluent openings at the periphery thereof and located at the bases of said tumble vanes for registry with the interior spaces thereof;

h. and a baffle plate for each tumble vane and located behind the array of openings to form a trap for cleaning agent entering the tumble vane, and having a distal edge located to prevent direct movement of cleaning agent to corresponding effluent opening; said baffle forming a trough at the periphery of the drum when the tumble vane is near the top of the drum, the distal edge of the baffle ensuring shuttling of cleaning agent across the openings inside the tumble vane upon rotation of the tumble vane for return of cleaning agent to the drum.

* * * * *